US009044062B2

(12) United States Patent
Delaney

(10) Patent No.: US 9,044,062 B2
(45) Date of Patent: Jun. 2, 2015

(54) CONVERTIBLE SHOE

(71) Applicant: Sean E. F. Delaney, Duluth, GA (US)

(72) Inventor: Sean E. F. Delaney, Duluth, GA (US)

( * ) Notice: Subject to any disclaimer, the term of this patent is extended or adjusted under 35 U.S.C. 154(b) by 74 days.

(21) Appl. No.: 14/071,359

(22) Filed: Nov. 4, 2013

(65) Prior Publication Data

US 2014/0053433 A1 Feb. 27, 2014

Related U.S. Application Data

(63) Continuation-in-part of application No. 13/593,500, filed on Aug. 23, 2012.

(51) Int. Cl.

| | |
|---|---|
| ***A43B 3/24*** | (2006.01) |
| ***A43B 1/00*** | (2006.01) |
| ***A43B 3/12*** | (2006.01) |

(52) U.S. Cl.

CPC ..... *A43B 3/242* (2013.01); *A43B 3/244* (2013.01); *A43B 1/0081* (2013.01); *A43B 3/122* (2013.01); *A43B 3/126* (2013.01)

(58) Field of Classification Search

CPC ..... A43B 3/122; A43B 3/102; A43B 3/242; A43B 3/248; A43B 3/244

USPC ..... 36/11.5, 101

See application file for complete search history.

(56) References Cited

U.S. PATENT DOCUMENTS

| | | | | |
|---|---|---|---|---|
| 2,183,277 | A * | 12/1939 | Heilhecker | 36/14 |
| 2,507,120 | A * | 5/1950 | Shapiro | 36/11.5 |
| 2,607,133 | A * | 8/1952 | Marlowe | 36/11.5 |
| 3,063,167 | A * | 11/1962 | Scholl | 36/11.5 |
| 5,926,978 | A * | 7/1999 | Smith | 36/101 |
| 6,640,464 | B2 * | 11/2003 | Hsin et al. | 36/11.5 |
| 6,772,539 | B1 * | 8/2004 | Tai | 36/11.5 |
| 7,802,381 | B2 * | 9/2010 | Condie | 36/101 |
| 8,220,184 | B2 * | 7/2012 | Albert | 36/101 |
| 2013/0185958 | A1 * | 7/2013 | McGuire | 36/101 |
| 2014/0230279 | A1 * | 8/2014 | Risner | 36/101 |

* cited by examiner

*Primary Examiner* — Ted Kavanaugh

(57) ABSTRACT

A convertible shoe enables people to easily modify a single shoe to form a total of at least three different shoe types. This reduces the bulkiness/amount of a traveler's luggage and reduces the burden of traveling without limiting a traveler's options of available shoe types. The convertible shoe can include a front removable shoe upper to convert between an open-toe and a closed-toe shoe. The convertible shoe can further include a rear removable shoe upper to convert the shoe between closed-back shoe and a sandal-type shoe. The sandal-type shoe can include a removable strap to convert between a strapped and a strapless sandal-type shoe.

12 Claims, 14 Drawing Sheets

CONVERTIBLE SHOE

CROSS-REFERENCE TO RELATED APPLICATIONS

This application is a continuation-in-part of U.S. patent application Ser. No. 13/593,500, filed Aug. 23, 2012, currently pending, the contents of which are herein incorporated by reference.

BACKGROUND OF THE INVENTION

The present invention relates to a convertible shoe and, more particularly, to a shoe that can be converted by the wearer/owner into a total of at least three different shoe types.

When people travel, they often need/desire to have more than one pair/type of shoe. This requires them to pack multiple shoes in their luggage, which increases the amount of luggage they must travel with and thus, increases the difficulty of traveling.

Current shoes do not allow the wearer/owner to easily and predictably convert their individual shoes into several different types of shoes.

As can be seen, there is a need for a convertible shoe that can be easily changed between different types of shoes.

SUMMARY OF THE INVENTION

In one aspect of the present invention, a convertible shoe comprises a sole-base; a front interlocking snap-fit strap disposed about a front edge of the sole-base; a rear interlocking snap-fit strap disposed about a rear edge of the sole-base; a non-removable sandal-type shoe upper attached to the sole-base; a front removable shoe upper securable to the non-removable sandal-type shoe upper and to the front interlocking snap-fit strap; and a rear removable shoe upper securable to the non-removable sandal-type shoe upper and to the rear interlocking snap-fit strap.

In another aspect of the present invention, a convertible shoe comprises a sole-base; a front interlocking snap-fit strap disposed about a front edge of the sole-base; a rear interlocking snap-fit strap disposed about a rear edge of the sole-base; a non-removable sandal-type shoe upper attached to the sole-base; a front removable shoe upper securable to the non-removable sandal-type shoe upper and to the front interlocking snap-fit strap; a rear removable shoe upper securable to the non-removable sandal-type shoe upper and to the rear interlocking snap-fit strap; a front receptor cavity on a front edge of the sole-base, the front receptor cavity operable to hold the front interlocking snap-fit strap therein; a rear receptor cavity on the rear edge of the sole-base, the rear receptor cavity operable to hold the rear interlocking snap-fit strap therein; a plurality of front cavity through holes disposed in the front receptor cavity; a plurality of rear cavity through holes disposed in the rear receptor cavity; a plurality of front sole-base holes on a top front portion of the sole-base and a plurality of rear sole-base holes on a top rear portion of the sole-base, the front sole-base holes communicating with the plurality of front cavity through holes and the rear sole-base holes communicating with the plurality of rear cavity through holes; a plurality of front interlocking snap-fit strap limbs fitting into the front cavity through holes; a plurality of rear interlocking snap-fit strap limbs fitting into the rear cavity through holes; a plurality of front upper limbs fitting into the front sole-base holes; a plurality of rear upper limbs fitting into the rear sole-base holes; front upper limb holes formed in the plurality of front upper limbs; rear upper limb holes formed in the plurality of rear upper limbs, wherein the front upper limb holes receive the plurality of front interlocking snap-fit strap limbs and the rear upper limb holes receive the plurality of rear interlocking snap-fit strap limbs; front attachment anchors disposed on ends of the front snap strap; rear attachment anchors disposed on ends of the rear snap strap; front receptacles, disposed in the front receptor cavity, receiving the front attachment anchors; and rear receptacles, disposed in the rear receptor cavity, receiving the rear attachment anchors.

These and other features, aspects and advantages of the present invention will become better understood with reference to the following drawings, description and claims.

BRIEF DESCRIPTION OF THE DRAWINGS

FIG. 12 also includes a view of the front and rear removable interlocking snap-fit straps;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a convertible shoe that enables people to easily modify a single shoe to form a total of at least three different shoe types. This reduces the bulkiness/amount of a traveler's luggage and reduces the burden of traveling without limiting a traveler's options of available shoe types. The convertible shoe can include a front removable shoe upper to convert between an open-toe and a closed-toe shoe. The convertible shoe can further include a rear removable shoe upper to convert the shoe between closed-back shoe and a sandal-type shoe. The sandal-type shoe can include a removable strap to convert between a strapped and a strapless sandal-type shoe.

Figure 1:
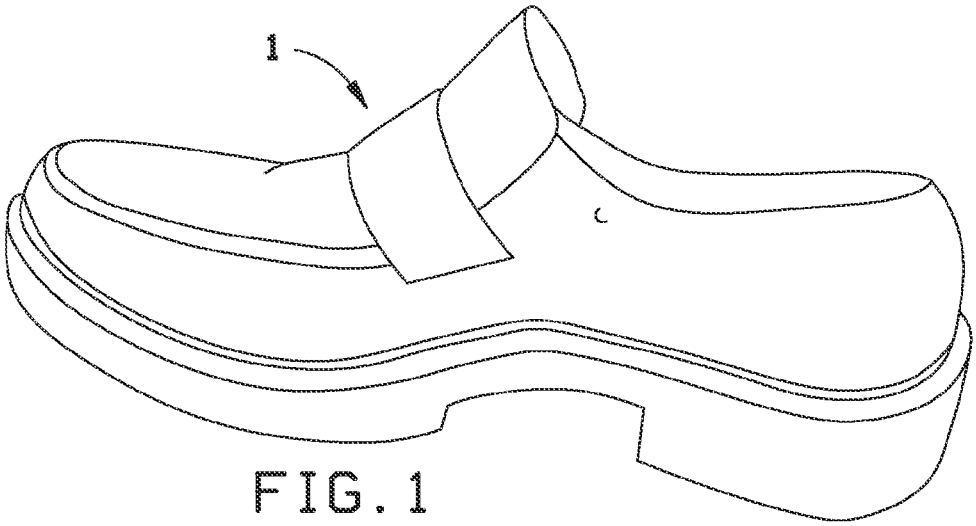
FIG. 1 is a perspective view of a convertible shoe according to an exemplary embodiment of the present invention.
Figure 2:
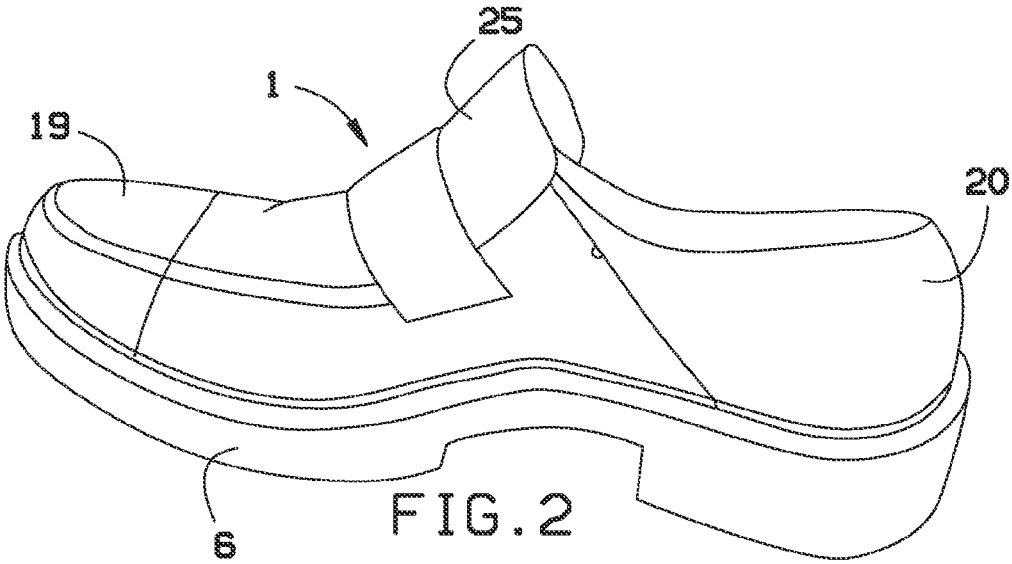
FIG. 2 is a perspective view of the convertible shoe of FIG. 1 showing lines dividing various convertible sections of the shoe.
Figure 3:
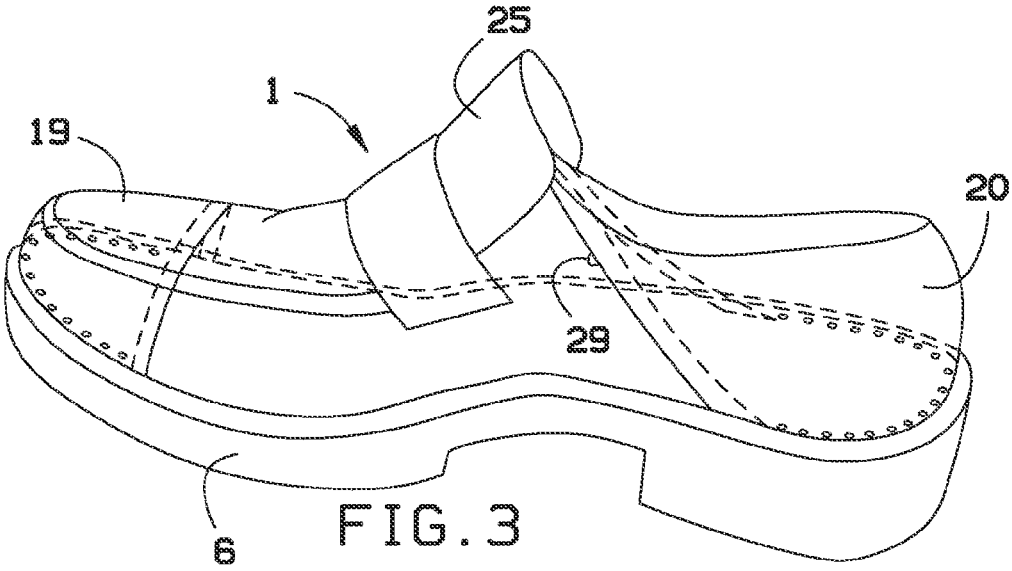
FIG. 3 is a perspective view of the convertible shoe of FIG. 1 showing various attachments for various convertible sections of the shoe.
Figure 4:
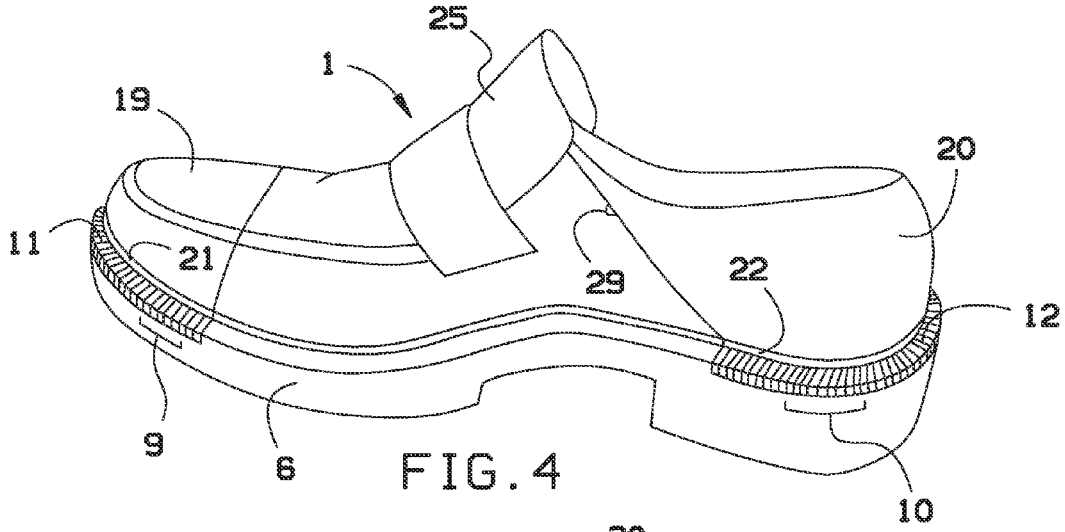
FIG. 4 is a perspective view of the convertible shoe of FIG. 1 showing front and rear snap plates for converting the shoe.
Figure 5:
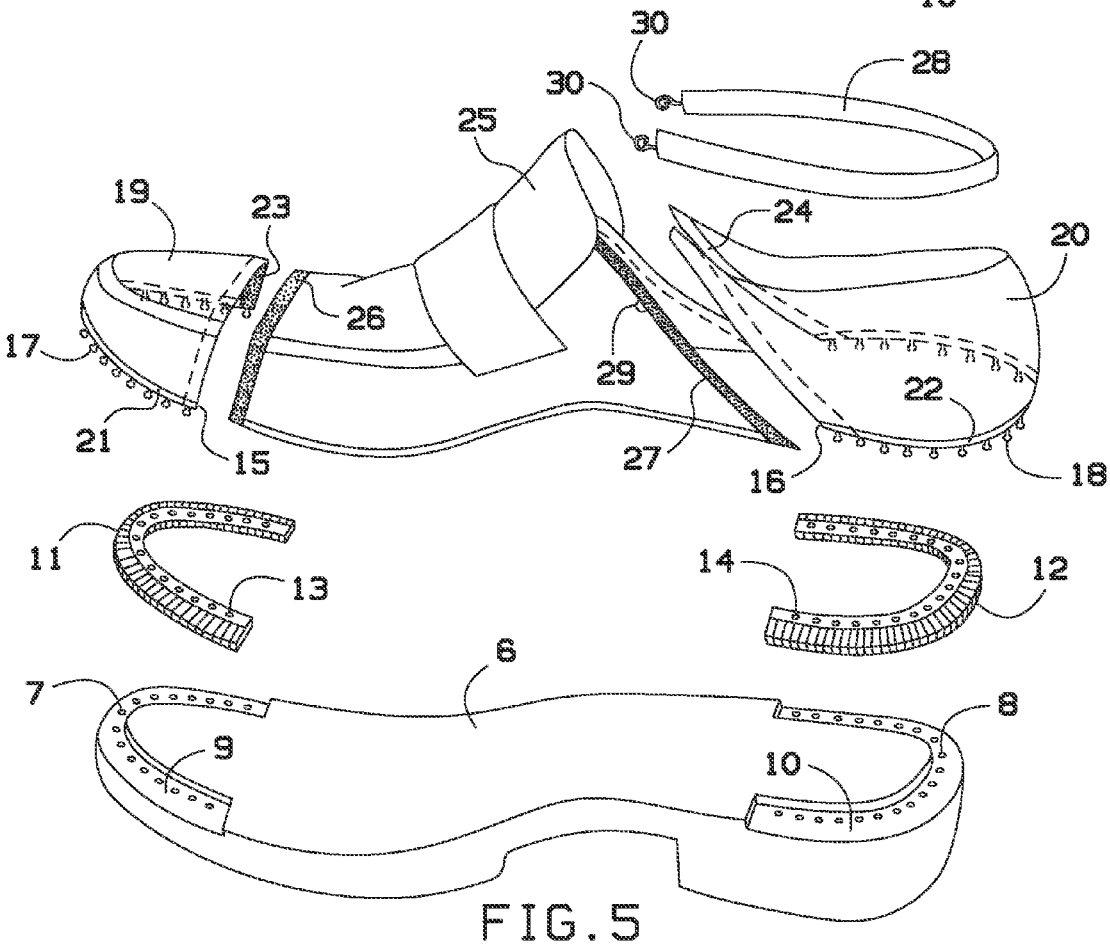
FIG. 5 is an exploded perspective view of the convertible shoe of FIG. 1 and includes a view of the detachable adjustable sandal strap, disposed with the hook attachments of the detachable adjustable sandal strap, which may be used when utilizing the convertible shoe as a closed-toe or open-toe sandal.
Figure 6:
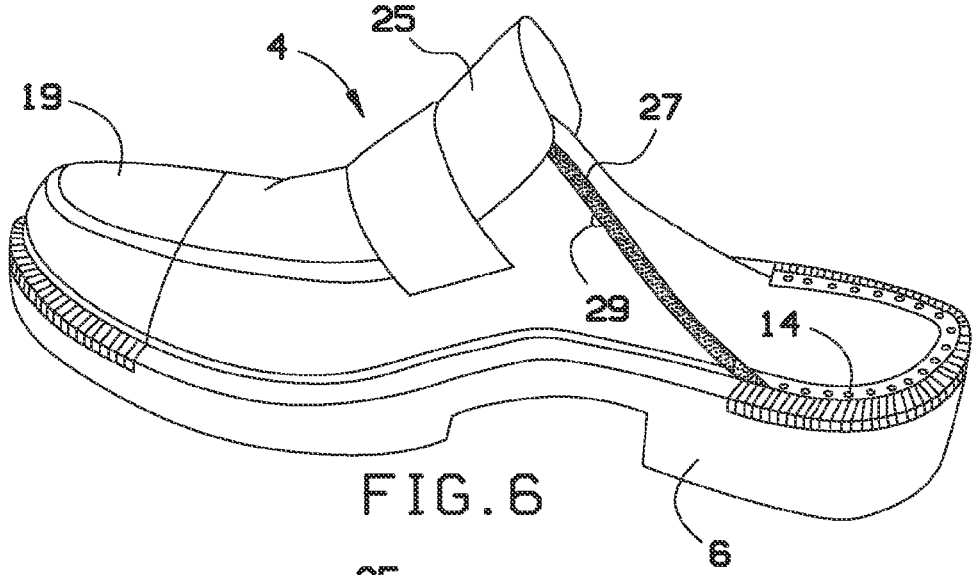
FIG. 6 is a perspective view of a closed-toe sandal-type shoe created from the shoe of FIG. 1.
Figure 7:
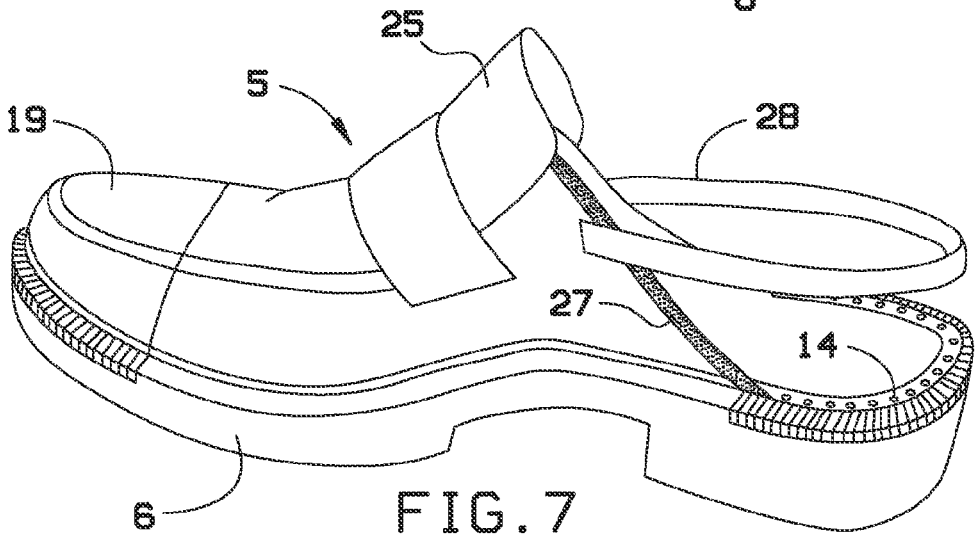
FIG. 7 shows a closed-toe sandal-type shoe with strap created from the shoe of FIG. 1.
Figure 8:
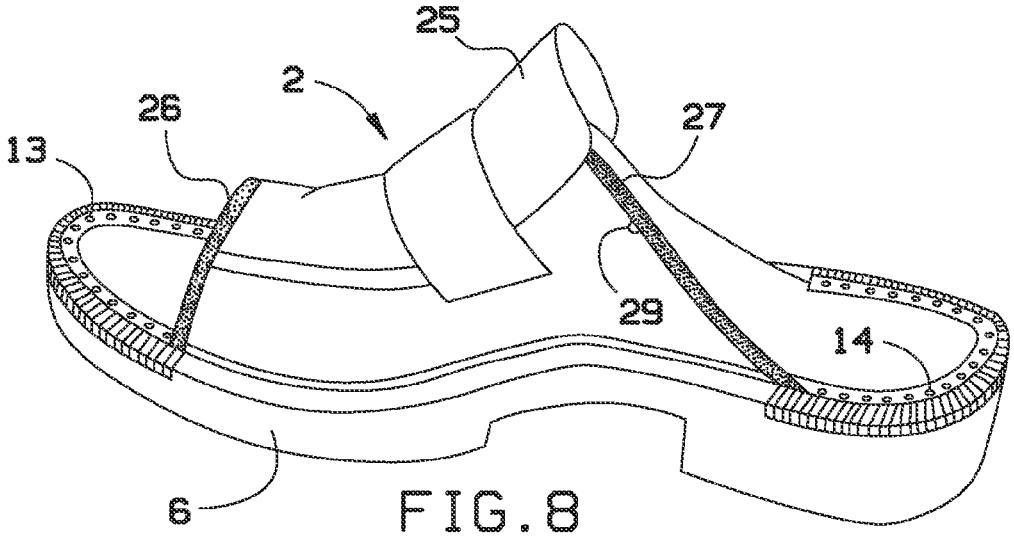
FIG. 8 shows a basic open-toe sandal-type shoe created from the convertible shoe of FIG. 1.
Figure 9:
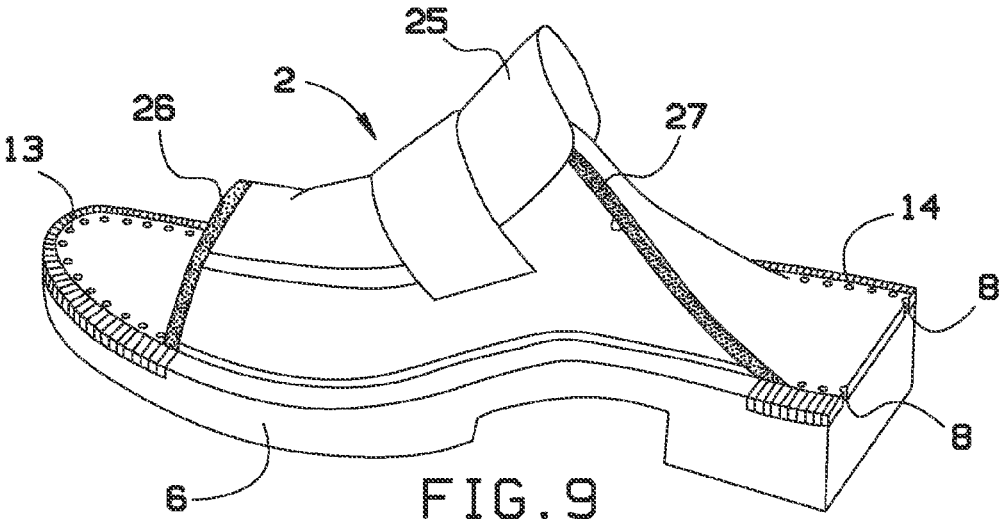
FIG. 9 shows the basic open-toe sandal-type shoe of FIG. 8, cross-sectioned to show a snap-fit receptor cavity on the rear sole-base.
Figure 10:
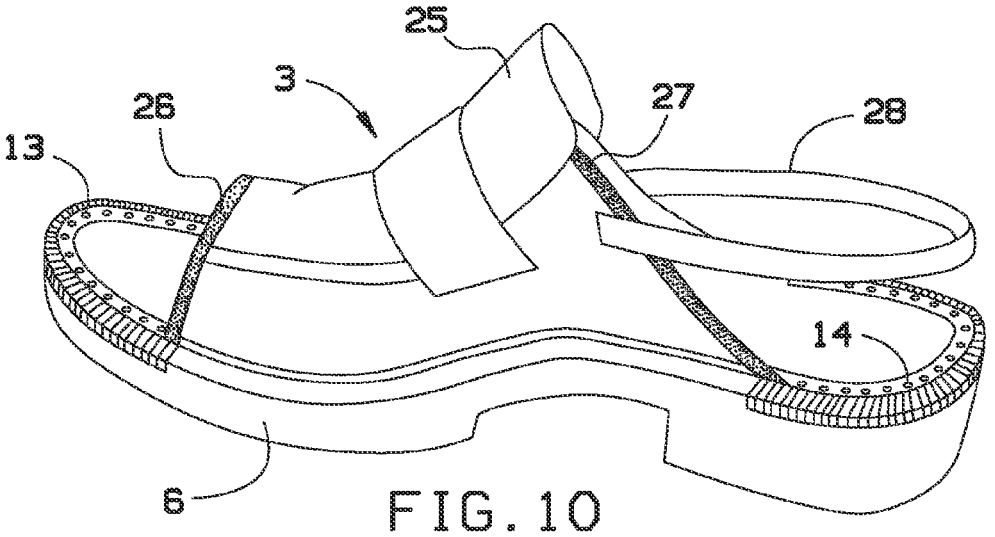
FIG. 10 shows a perspective view of a basic open-toe sandal-type shoe with a strap created from the convertible shoe of FIG. 1.
Figure 11A:
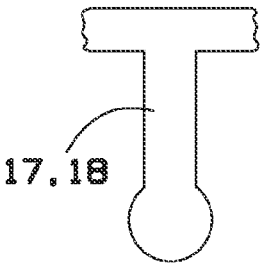
FIG. 11A shows a snap fit ball according to an exemplary embodiment of the present invention.
Figure 11B:
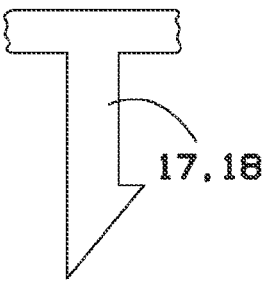
FIG. 11B shows a snap fit barbed leg according to an exemplary embodiment of the present invention.

Referring now to the FIGS. 1 through 11B, a convertible shoe 1 is a shoe made from a basic open-toe sandal-type shoe 2 to which can be reversibly attached and detached a front removable shoe upper 19 and a rear removable shoe upper 20. The basic open-toe sandal-type shoe 2 can be formed from a sole-base 6 with a permanently attached non-removable sandal-type upper 25 and a permanently attached snap-fit front plate 11 and snap-fit rear plate 12.

The front removable upper 19 can attach to the basic open-toe sandal-type shoe 2 by passing the limbs of a front snap-fit 15 of the front removable upper 19 through holes 13 of the front portion of the snap-plate 11 of the basic open-toe sandal-type shoe 2, such that the barbs/balls 17 of the snap-fit 15 reside in the receptor cavities 7 of a snap-plate nesting place 9 on the sole-base 6 of the basic open-toe sandal-type shoe 2 and by attaching a Velcro-attachment-zone 23 of the front removable upper 19 to the front Velcro-attachment-zone 26 of the non-removable sandal-type upper 25 of the basic open-toe sandal-type shoe 2. While Velcro is described herewithin, any hook and loop type fastener may be used and the position of the hook side and loop side of the fastener may be on either attachment zone 23, 26.

The rear removable upper 20 can attach to the basic open-toe sandal-type shoe 2 by passing the limbs of a rear snap-fit 16 of the rear removable upper 20 through holes 14 of the rear portion of a rear snap-plate 12 of the basic open-toe sandal-type shoe 2, such that the barbs/balls 18 of the rear snap-fit 16 reside in the receptor cavities 8 of a snap-plate nesting place 10 on the sole-base 6 of the basic open-toe sandal-type shoe 2 and by attaching the Velcro-attachment-zone 24 of the rear removable upper 20 to the rear Velcro-attachment-zone 27 of the sandal-type upper 25 of the basic open-toe sandal-type shoe 2.

The sole-base 6 will typically be made of rubber but may be made of any other material suitable as a shoe bottom. The snap-plates 11, 12 can be made of a firm material (e.g., plastic) that has enough rigidity to secure the snap-fits 15, 16 in place yet enough flexibility to allow necessary deformation of the shoe with normal walking. Note that two snap-plate versions are possible. Either the snap-plate forms a continuous layer on top of the sole base 6 or the snap-plate includes two separate snap-plates, front and rear (as shown), that reside on top of the sole base 6 and the corresponding snap-plate nesting places 9, 10.

The uppers 19, 25, 20 can be made of leather or any other material that is typically used for, or that is suitable for, use as a shoe upper.

The snap-fits 15, 16 can be made of a material that is rigid enough (e.g., plastic) to provide the strength necessary for the snap-fits to firmly hold the removable uppers 19, 20 in place when they are attached to the basic open-toe sandal-type shoe 1 and during normal walking. Note that several snap-fit designs 17, 18 are possible based on previously published designs e.g., ball & socket-type (FIG. 11A), barb-type cantilever (FIG. 11B), U & L cantilever type, and the like.

A user may wear the basic open-toe sandal-type shoe 2 with both the front 19 and rear 20 removable uppers attached forming the convertible shoe 1, either only the front removable upper 19 attached forming the closed-toe sandal-type shoe 4, or with neither the front 19 nor rear 20 removable uppers attached forming the basic open-toe sandal-type shoe 2. In addition both the basic open-toe sandal-type shoe 2 and the closed-toe sandal-type shoe 4 may have a detachable adjustable sandal strap 28 attached, via a hook attachment 30 of the detachable adjustable sandal strap 28, to an attachment loop 29 of the non-removable sandal-type upper 25, or detached.

Either removable upper 19 or 20 can be attached to the basic open-toe sandal-type shoe 2 by inserting the limbs 17 and 18 of the snap-fits 15 and 16 respectively through the corresponding holes 13 and 14 in the snap-plates 11 and 12 such that the barbs/balls of the snap-fits 15 and 16 reside securely in the receptor cavities 7 and 8 of the corresponding portions of the sole-base 6 in the region of the snap-plate nesting places 9 and 10, and by attaching the Velcro attachment zones 23 and 24 of the uppers 19 and 20 to the corresponding Velcro attachment zones 26 and 27 on the non-removable sandal-type upper 25.

Similarly, to remove either removable upper 19 or 20 from the basic open-toe sandal-type shoe 2, the user simply pulls upward on the corresponding removable upper 19 or 20 with enough force to dislodge the snap-fits 15 and 16 from their corresponding regions of snap-plates 11 and 12.

Should the user/wearer wish to do so he/she may attach the detachable adjustable sandal strap 28 to either the open-toe sandal-type shoe 2 or the closed-toe sandal type shoe 4 by inserting the hook attachment 30 of the detachable adjustable sandal strap 28, through the attachment loop 29 of the non-removable sandal-type upper 25.

To make the convertible shoe of the present invention, the shoe sole 6 can be created using standard shoe making techniques. The snap plate nesting places 9 and 10 can then be carved out of shoe sole 6. A mold of the snap-plate nesting places 9 and 10 can be made and this can be used to create plastic forms for the snap-fit plates 11 and 12. The snap-fit plates 11 and 12 can be placed into their positions at the respective nesting places 9 and 10 on shoe sole 6 and holes can be drilled through the snap-fit plates 11 and 12 and into the snap-fit plate nesting places 9 and 10, forming the holes 13 and 14 in the respective snap-fit plates as well as forming the snap-fit receptor cavities 7 and 8 in the shoe sole 6. The snap-fit receptor cavities 7 and 8 can then be widened to accommodate the full relaxed size of ball/barb of the snap-fits 17 and 18 such that the balls/barbs are not compressed, thus enabling the snap-fits 15 and 16 to resist dislocation through the holes 13 and 14 of the snap-plates 11 and 12 and thus from shoe sole 6 whenever the snap-fit balls/barbs are inserted into the receptor cavities 7 and 8. The snap-plates 11 and 12 can then be bonded securely into their positions at their respective snap-fit nesting places 9 and 10 on shoe sole 6.

Leather uppers can then be created using standard shoe-making techniques but with a redundancy of material such that there is an overlap of material at the points where the removable upper 19 would join the non-removable upper 25 and where the removable upper 20 would join the non-removable upper 25 at the Velcro-attachment zones 23, 26 and 24, 27 respectively. This redundancy of material can, in fact, be lined with Velcro to form the Velcro attachment zones 23 and 26 as well as 24 and 27.

The snap-fits 15 and 16 can be made by forming plastic ball/barb snap-fits of a predetermined dimension with the neck of the snap-fits attached to a plastic hoop of the same shape as the snap-plates using standard plastic molding techniques. The snap-fits 15 and 16 can be bonded to removable uppers 19 and 20.

Figure 12:
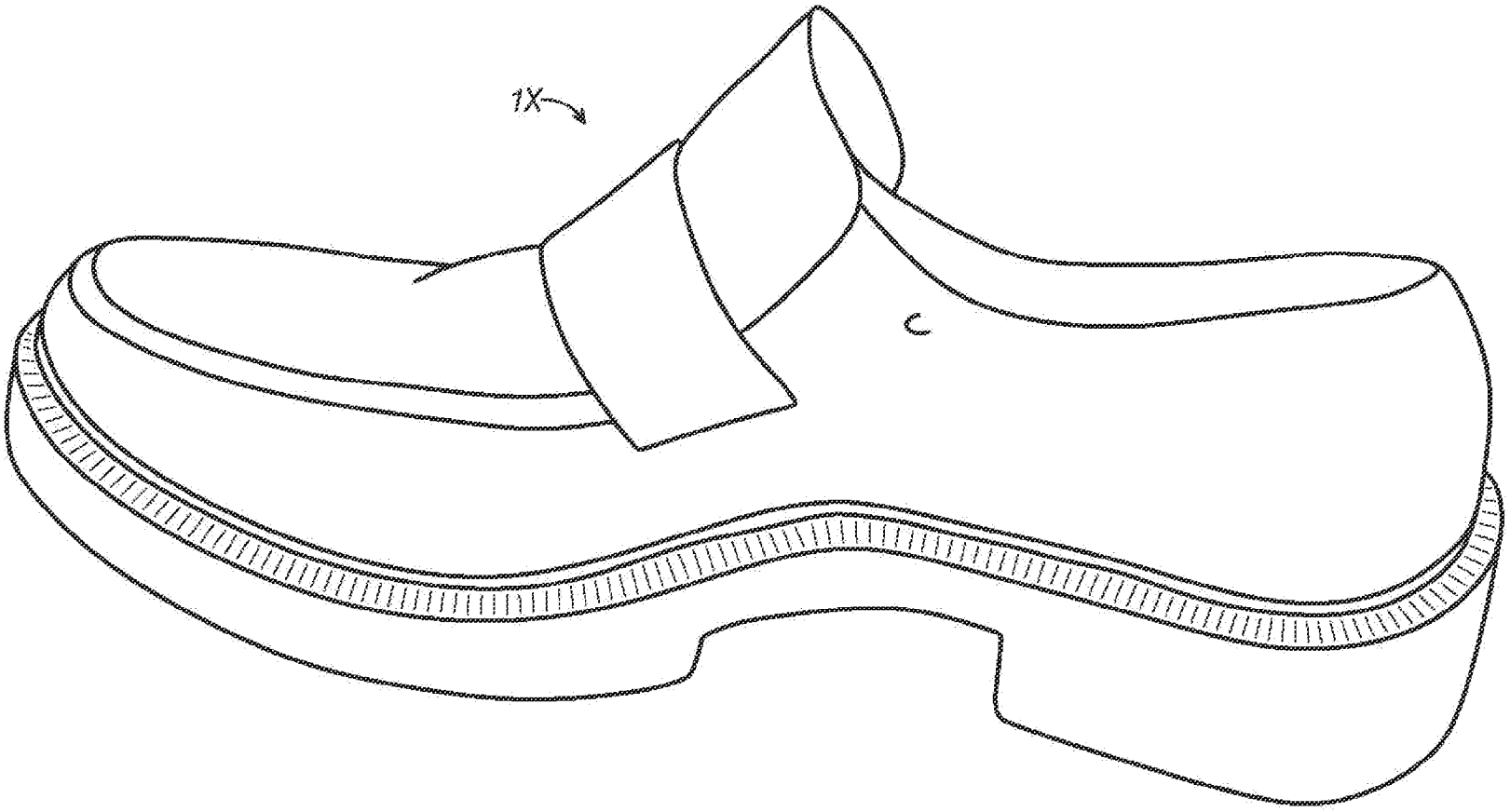
FIG. 12 is a perspective view of a convertible shoe according to an exemplary embodiment of the present invention.
Figure 13:
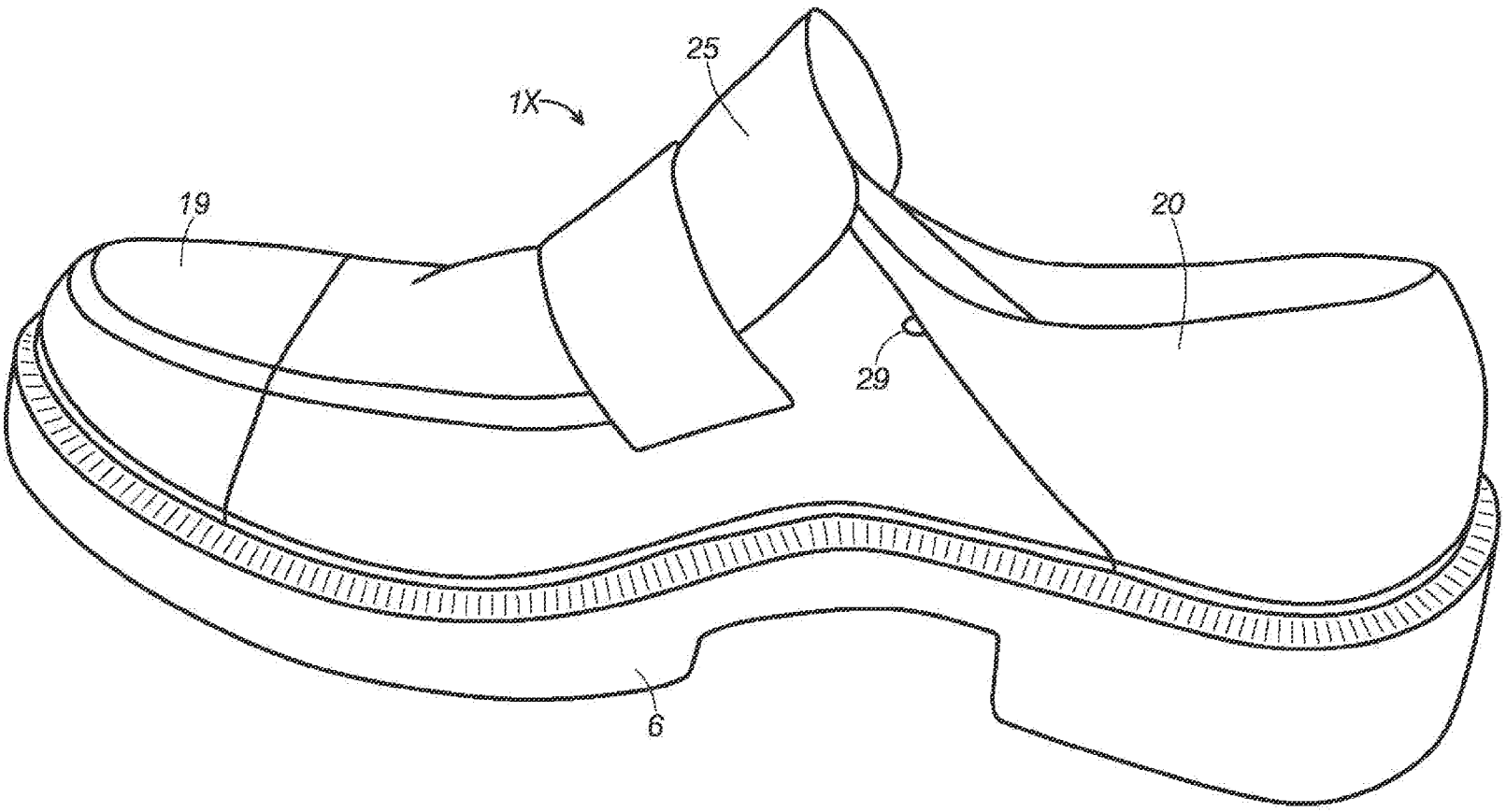
FIG. 13 is a perspective view of the convertible shoe of FIG. 12 showing lines dividing various convertible sections of the shoe.
Figure 14:
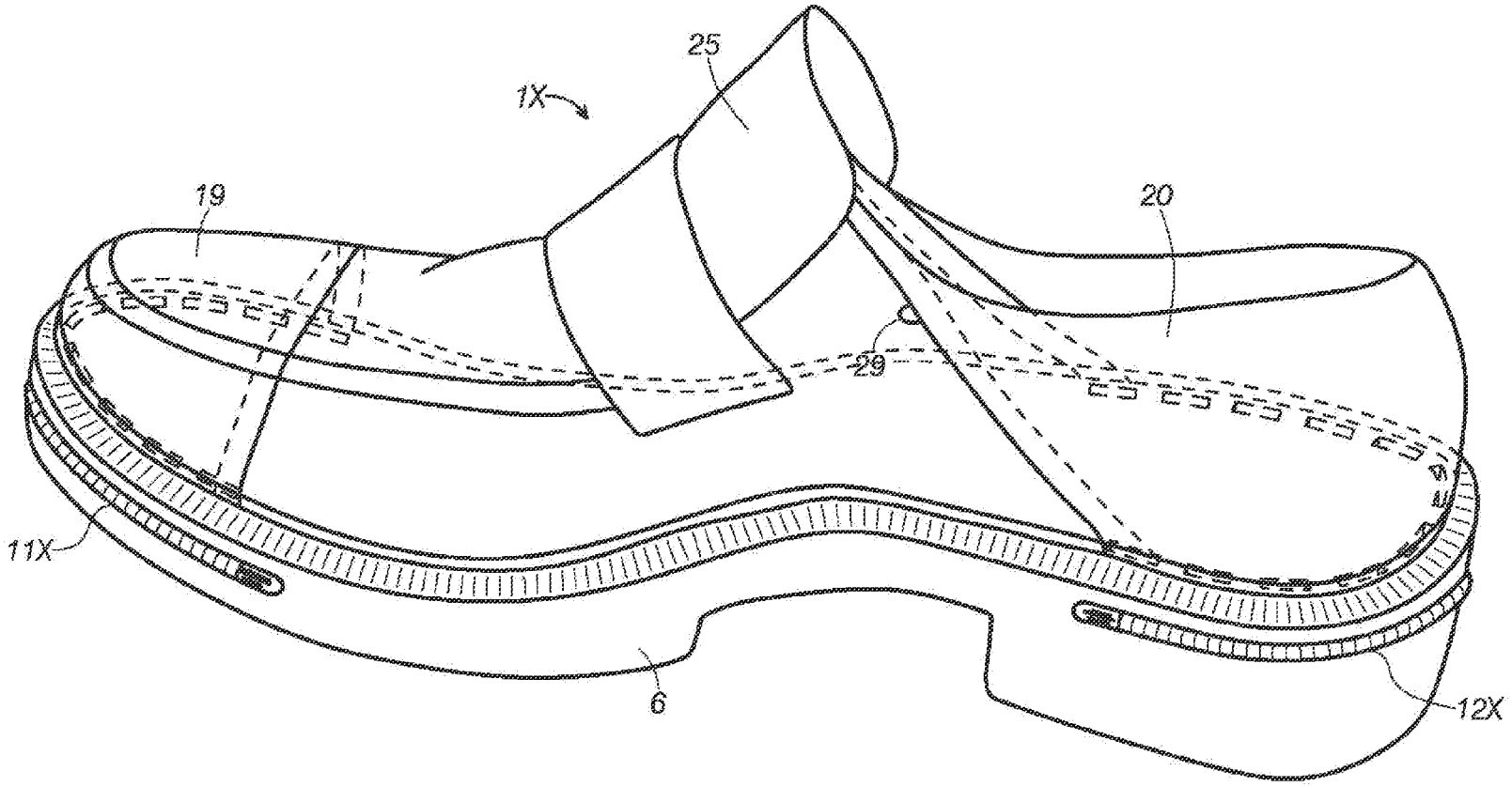
FIG. 14 is a perspective view of the convertible shoe of FIG. 12 showing various attachments for various convertible sections of the shoe.
Figure 15:
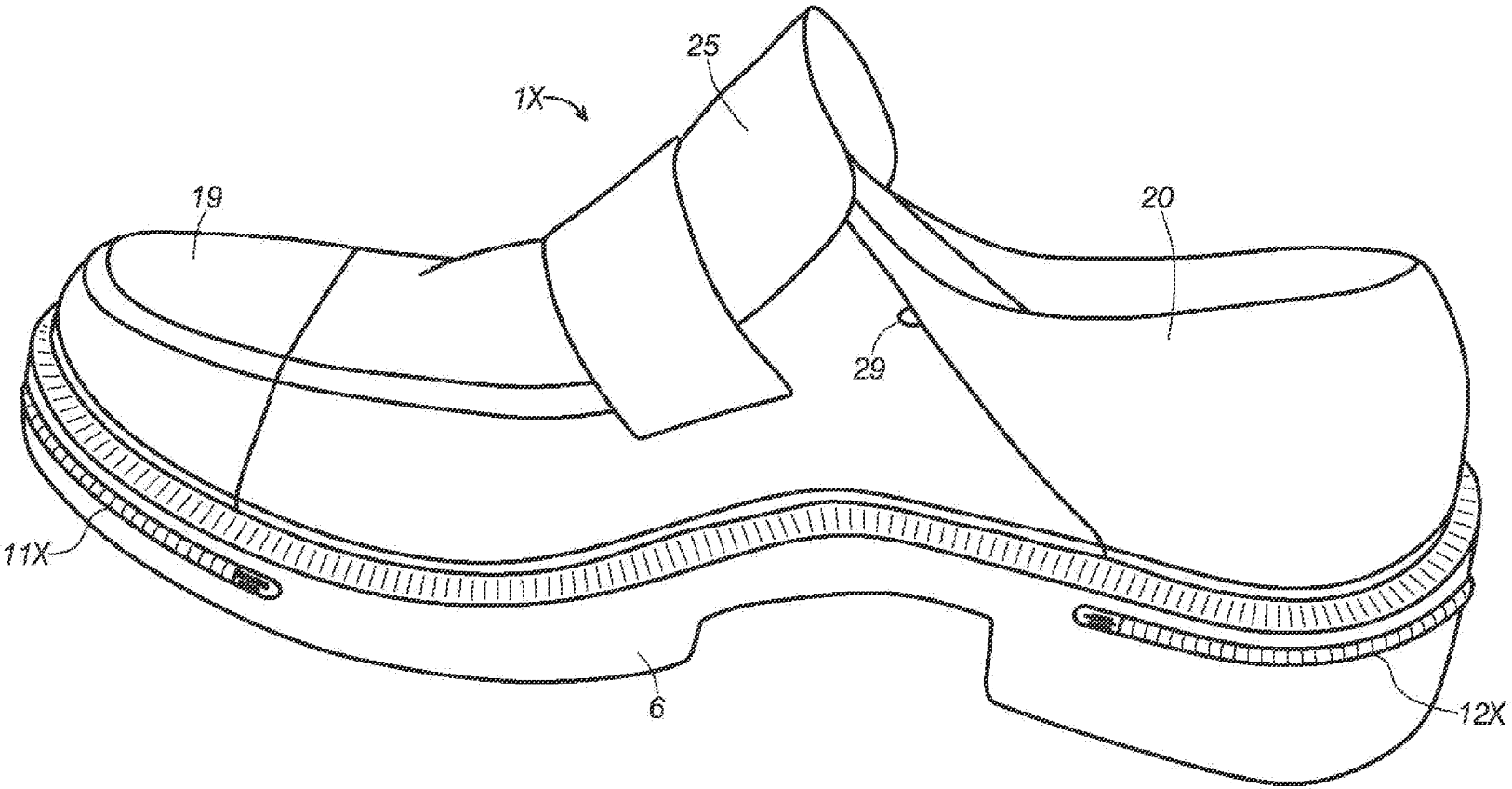
FIG. 15 is a perspective view of the convertible shoe of FIG. 12 showing front and rear removable interlocking snap-fit straps for converting the shoe.
Figure 16:
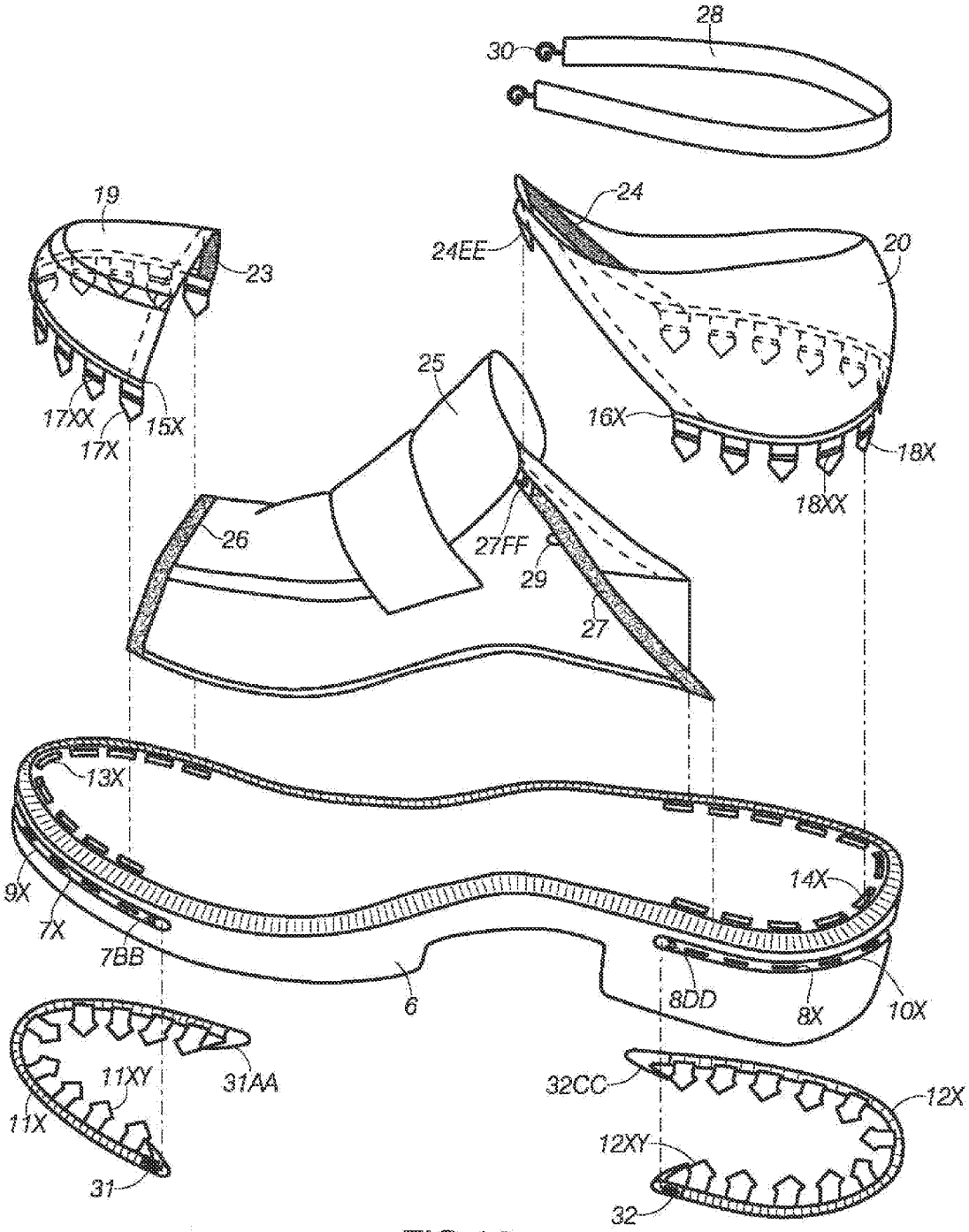
FIG. 16 is an exploded perspective view of the convertible shoe of FIG. 12 and includes a view of the detachable adjustable sandal strap, disposed with hook attachments of the detachable adjustable sandal strap, which may be used when utilizing the convertible shoe as a closed-toe or open-toe sandal.
Figure 17:
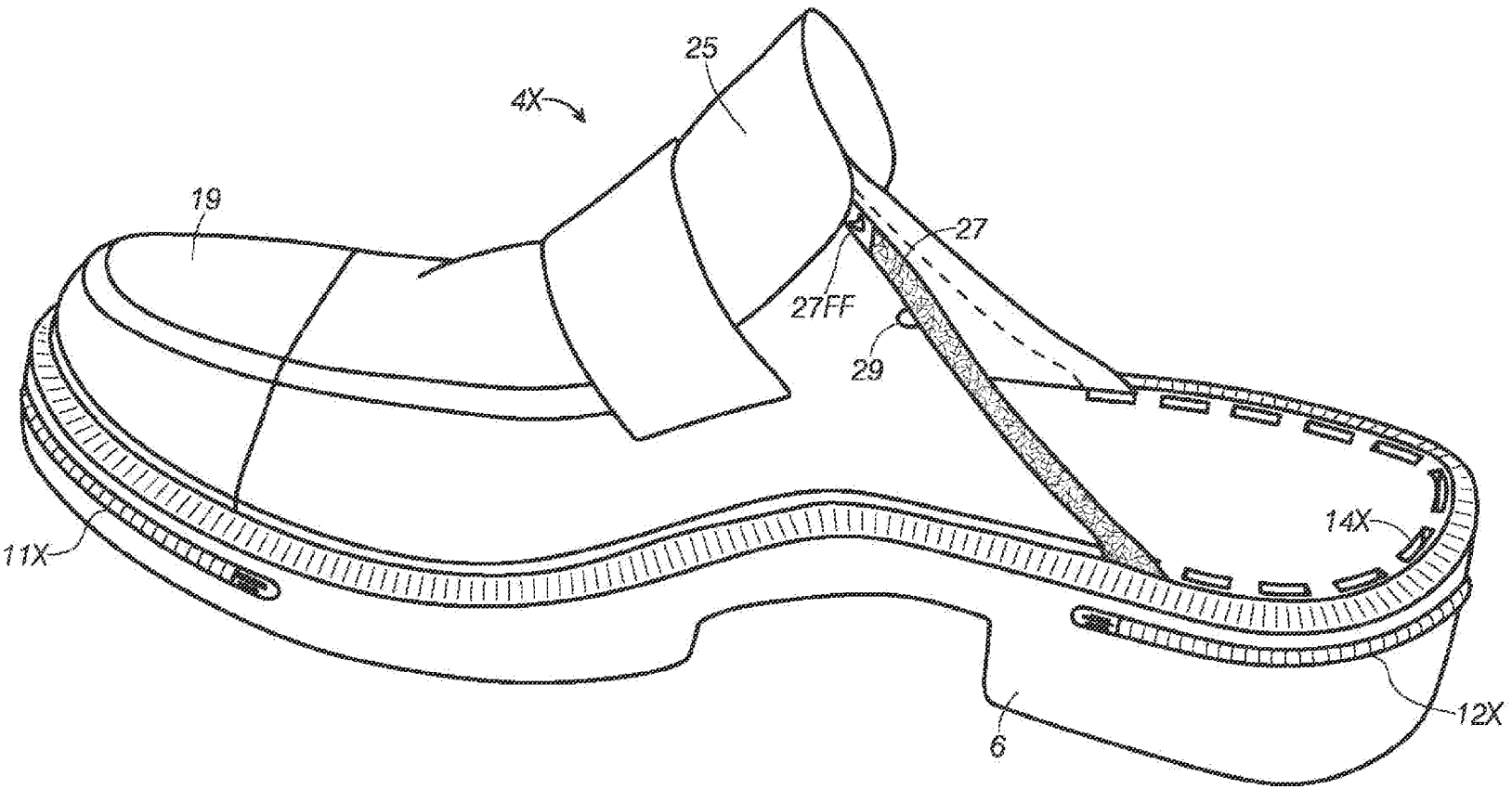
FIG. 17 is a perspective view of a closed-toe sandal-type shoe created from the shoe of FIG. 12.
Figure 18:
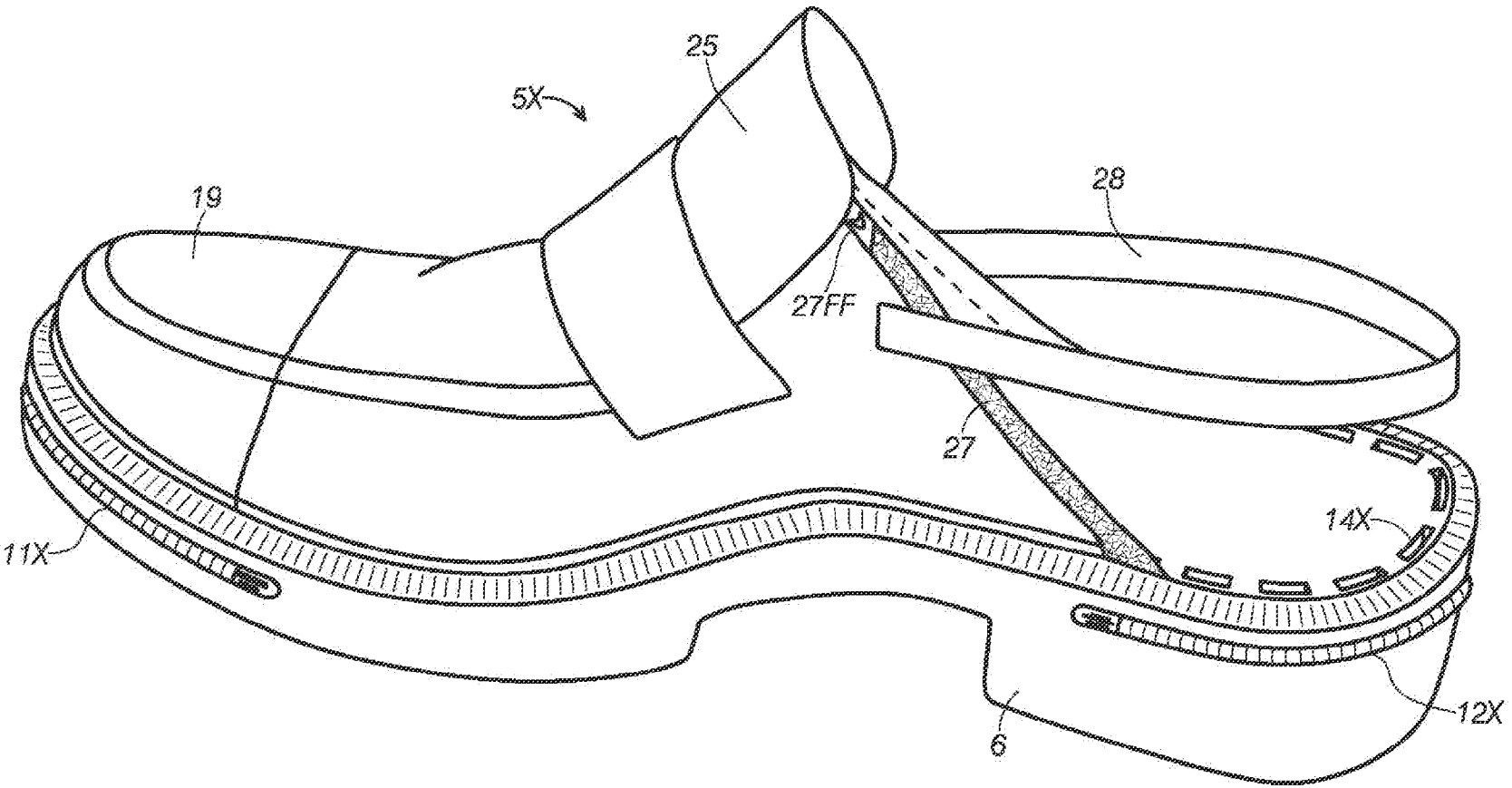
FIG. 18 shows a closed-toe sandal-type shoe with strap created from the shoe of FIG. 12.
Figure 19:
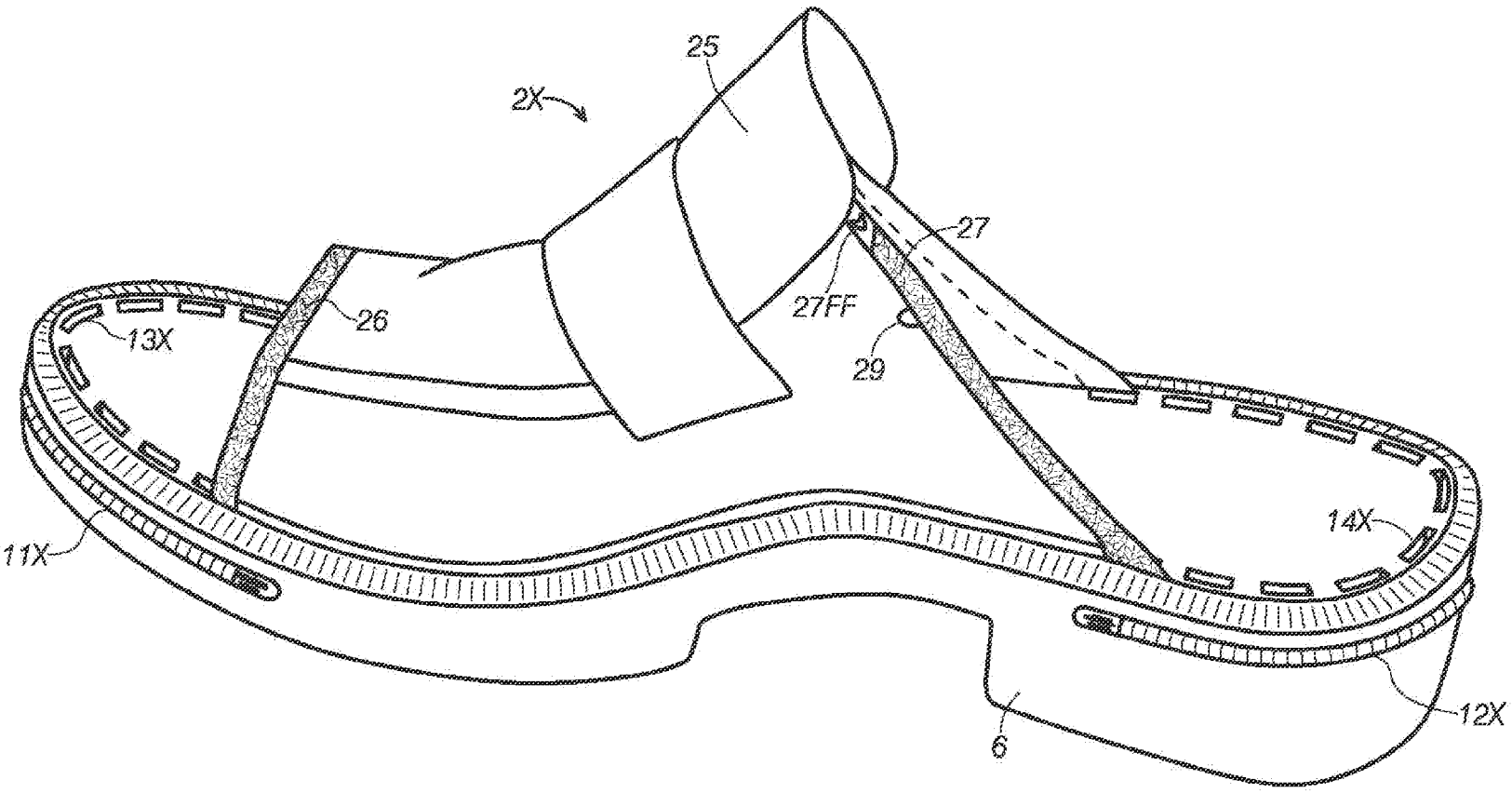
FIG. 19 shows a basic open-toe sandal-type shoe created from the convertible shoe of FIG. 12.
Figure 20:
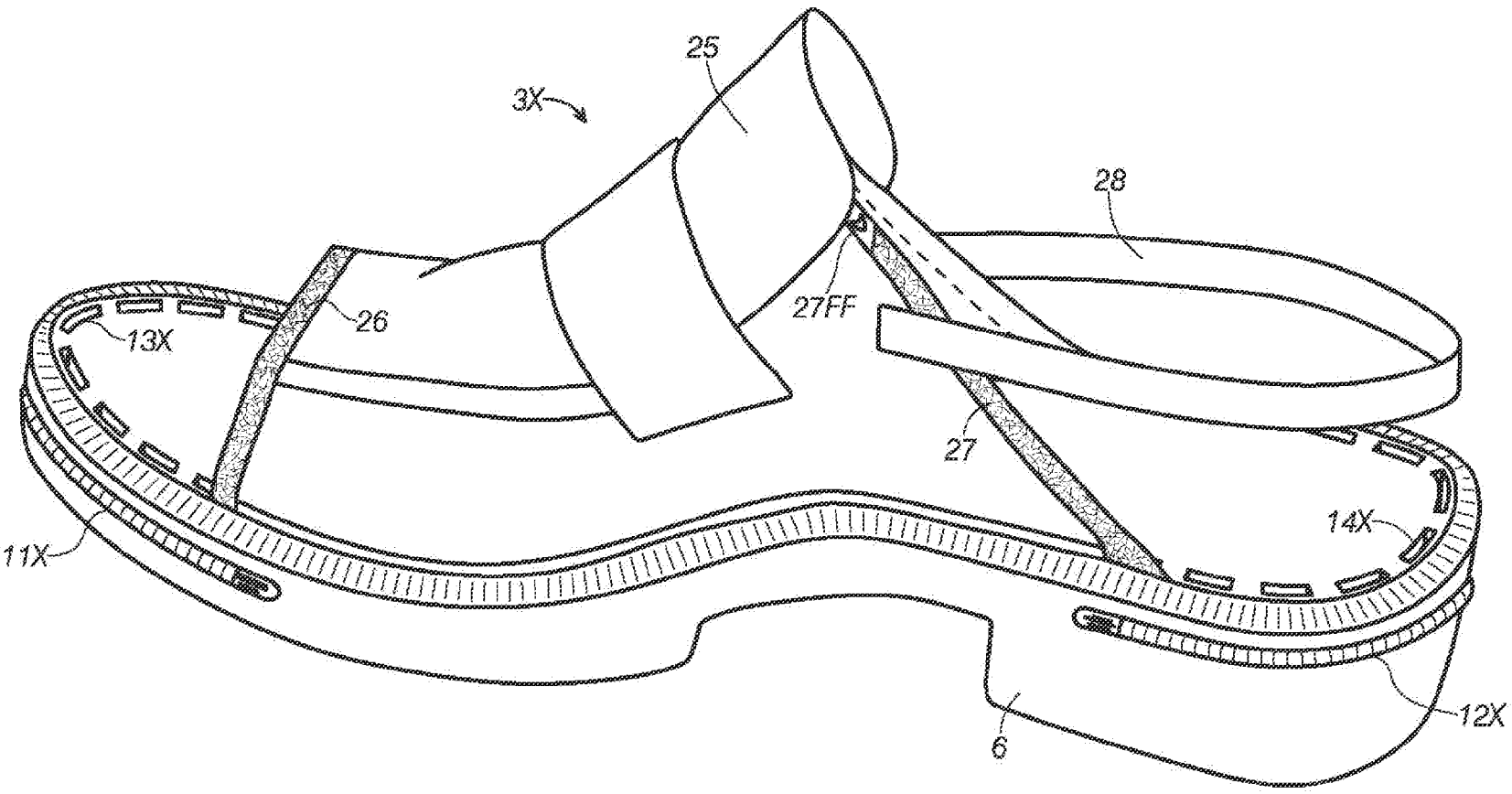
FIG. 20 shows a perspective view of a basic open-toe sandal-type shoe with a strap created from the convertible shoe of FIG. 12.
Figure 21:
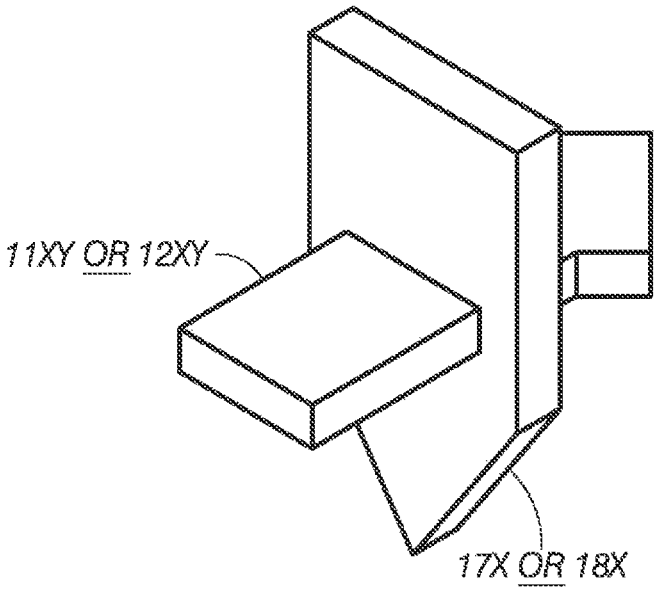
FIG. 21 shows the interlocking behavior of the snap-fit limbs of the removable uppers and the removable interlocking snap-fit straps.

Referring now to FIGS. 12 through 21, a convertible shoe 1X is a shoe made from a basic open-toe sandal-type shoe 2X to which can be reversibly attached and detached a front removable shoe upper 19 and a rear removable shoe upper 20. The basic open-toe sandal-type shoe 2X can be formed from a sole-base 6 with a permanently attached non-removable sandal-type upper 25 and a removable interlocking snap-fit front strap 11X and removable interlocking snap-fit rear strap 12X.

The front removable upper 19 can attach to the basic open-toe sandal-type shoe 2X by passing the limbs 17X of a front snap-fit 15X of the front removable upper 19 through holes 13X of the front portion of the sole 6 of the basic open-toe sandal type shoe 2X, then passing the limbs 11XY of the removable interlocking snap-fit front strap 11X through the holes 7X on the sole 6 of the basic open toe sandal-type shoe 2X and through the holes 17XX of the limbs 17X of front snap-fit 15X, and by securing the removable interlocking snap-fit front strap 11X to the sole 6 of the basic open toe sandal-type shoe 2X by inserting attachment anchor 31AA into receptacle 7BB by pulling on attachment anchor 31AA such that stretchable zone 31 slightly elongates and is under tension, and by attaching a Velcro-attachment-zone 23 of the front removable upper 19 to the front Velcro-attachment-zone 26 of the non-removable sandal-type upper 25 of the basic open-toe sandal-type shoe 2X.

The rear removable upper 20 can attach to the basic open-toe sandal-type shoe 2X by passing the limbs 18X of a rear snap-fit 16X of the rear removable upper 20 through holes 14X of the rear portion of the sole 6 of the basic open-toe sandal type shoe 2X, then passing the limbs 12XY of the removable interlocking snap-fit rear strap 12X through the holes 8X on the sole 6 of the basic open toe sandal-type shoe 2X and through the holes 18XX of the limbs 18X of rear snap-fit 16X, and by securing the removable interlocking snap-fit rear strap 12X to the sole 6 of the basic open toe sandal-type shoe 2X by inserting attachment anchor 32CC into receptacle 8DD by pulling on attachment anchor 32CC such that stretchable zone 32 slightly elongates and is under tension, and by attaching a Velcro-attachment-zone 24 of the rear removable upper 20 to the rear Velcro-attachment-zone 27 of the non-removable sandal-type upper 25 of the basic open-toe sandal-type shoe 2*x*, and by inserting attachment anchor 24EE of the rear removable upper 20 into receptacle 27FF of the non-removable sandal-type upper 25 of the basic open-toe sandal-type shoe 2X.

The sole base 6 will typically be made of rubber but may be made of any other material suitable as a shoe bottom. The snap-fits 15X, 16X, removable interlocking snap-fit straps 11X, 12X, and limbs 17X, 18X, 11XY, 12XY can be made of a material that is rigid enough (e.g., plastic) to provide the strength necessary for the snap-fits to firmly hold the removable uppers 19, 20 in place when they are attached to the basic-open-toe sandal-type shoe 2X during normal walking. Note however that the hoops of removable interlocking snap-fit straps 11X and 12X to which the limbs 11XY and 12XY are attached must also be flexible enough to allow deformation during the procedure of attaching and detaching them to the sole 6 of the basic open toe sandal-type shoe 2X.

The uppers 19, 25, 20 can be made of leather or any other material that is typically used for, or that is suitable for, use as a shoe upper.

Either removable upper 19 or 20 can be attached to the basic open-toe sandal-type shoe 2X by inserting the limbs 17X and 18X of the snap-fits 15X and 16X respectively through the corresponding holes 13X and 14X respectively in the sole 6 of the basic open toe sandal-type shoe, then inserting limbs 11XY and 12XY of the removable interlocking snap-fit straps 11X and 12X respectively through the corresponding holes 7X and 8X respectively on sole 6 of the basic open toe sandal-type shoe 2X and through the corresponding holes 17XX and 18XX on the respective limbs 17X and 18X of snap-fits 15X and 18X respectively, then securing the removable interlocking snap-fit straps 11X and 12X to the sole 6 of the basic open toe sandal-type shoe 2X by pulling on attachment anchors 31AA and 32CC such that stretchable zones 31 and 32 slightly elongate and are under tension and inserting attachment anchors 31AA and 32CC respectively into corresponding receptacles 7BB and 8DD in the sole 6 of the basic open toe sandal-type shoe 2X, and by attaching the Velcro attachment zones 23 and 24 of the uppers 19 and 20 to the corresponding Velcro attachment zones 26 and 27 on the non-removable sandal-type upper 25 and securing removable upper 20 to the non-removable sandal-type upper 25 of the basic open-toe sandal-type shoe 2X by inserting attachment anchor 24EE into receptacle 27FF of the non-removable sandal-type upper 25 of the basic open-toe sandal-type shoe 2X.

Similarly to remove either removable upper 19 or 20 from the basic open toe sandal-type shoe 2X, the user simply pulls on attachment anchor 31AA or 32CC respectively such that stretchable zone 31 or 32 respectively slightly elongates so that it is under tension and by then removing attachment anchor 31AA or 32CC respectively from its corresponding receptacles 7BB or 8DD in the sole 6 of the basic open toe sandal-type shoe 2X, then further pulling on removable interlocking snap-fit strap 11X or 12X respectively such that limb 11XY or 12XY dislodges from its corresponding holes 17XX or 18XX on the respective limb 17X or 18X of snap-fits 15X or 18X respectively and dislodges from corresponding holes 7X or 8X on sole 6 of the basic open toe sandal-type shoe 2X, then pulling upward on the corresponding removable upper 19 or 20 with enough force to dislodge the limbs 17X or 18X of snap-fits 15X or 16X respectively from its corresponding holes 13X or 14X on sole 6 of the basic open toe sandal-type shoe 2X, and in the case of removable upper 20 pulling up on attachment anchor 24EE with enough force to dislodge it from receptacle 27FF on the non-removable upper 25.

It is anticipated that when either removable upper 19 or 20 is removed from the basic open toe sandal-type shoe 2X, that prior to wearing the user will reattach the corresponding removable interlocking snap-fit straps 11X or 12X respectively by inserting limbs 11XY or 12XY of the removable interlocking snap-fit strap 11X or 12X respectively through the corresponding holes 7X or 8X on sole 6 of the basic open toe sandal-type shoe 2X and through the corresponding holes 17XX or 18XX on the respective limbs 17X or 18X of snap-fits 15X or 18X respectively, then securing the removable interlocking snap-fit strap 11X or 12X to the sole 6 of the basic open toe sandal-type shoe 2X by pulling on attachment anchor 31AA or 32CC such that the respective stretchable zone 31 or 32 slightly elongates so that it under tension, and inserting attachment anchor 31AA or 32CC respectively into corresponding receptacles 7BB or 8DD in the sole 6 of the basic open toe sandal-type shoe 2X.

Should the wearer wish to do so he/she may attach the detachable adjustable sandal strap 28 to either the basic open-toe sandal-type shoe 2X or the closed-toe sandal-type shoe 4X by inserting the hook attachment 30 of the detachable adjustable sandal strap 28, through the attachment loop 29 of the non-removable sandal-type upper 25.

To make the convertible shoe of the present invention, the shoe sole 6 can be created using standard shoe making techniques. The holes 13X, 14X and 7X, 8X as well as grooves 9X, 10X can be carved out of shoe sole 6.

Leather uppers can then be created using standard shoe-making techniques but with a redundancy of material such that there is an overlap of material at the points where the removable upper 19 would join the non-removable upper 25 and where the removable upper 20 would join the non-removable upper 25 at the Velcro-attachment zones 23, 26, 24, 27 respectively. This redundancy of material can, in fact, be lined with Velcro to form the Velcro attachment zones 23 and 26 as well as 24 and 27. In the case of removable upper 20 an attachment anchor 24EE, formed using standard plastic molding techniques can be bonded to the superior end of the Velcro attachment zones.

The snap-fits 15X and 16X can be made by forming plastic barb snap-fits of a predetermined dimension with the neck of the snap-fits attached to a plastic hoop using standard plastic molding techniques. The snap-fits 15X and 16X can be bonded to the removable uppers 19 and 20.

The removable interlocking snap-fit straps 11X and 12X can be made by forming plastic barb snap-fits of a predetermined dimension with the neck of the snap-fits attached to a plastic hoop using standard plastic molding techniques. The ends of the hoops can be bonded to a stretchable material to form the stretchable zones 31 and 32 respectively and these can in turn be bonded to plastic attachment anchors 31AA and 32CC, respectively, formed using standard plastic molding techniques.

It should be understood, of course, that the foregoing relates to exemplary embodiments of the invention and that modifications may be made without departing from the spirit and scope of the invention as set forth in the following claims.

What is claimed is:

1. A convertible shoe comprising:

a sole-base;

a front interlocking snap-fit strap disposed about a front edge of the sole-base;

a rear interlocking snap-fit strap disposed about a rear edge of the sole-base;

a non-removable sandal-type shoe upper attached to the sole-base;

a front removable shoe upper securable to the non-removable sandal-type shoe upper and to the front interlocking snap-fit strap; and a rear removable shoe upper securable to the non-removable sandal-type shoe upper and to the rear interlocking snap-fit strap.

2. The convertible shoe of claim 1, further comprising:

a front receptor cavity on a front edge of the sole-base, the front receptor cavity operable to hold the front interlocking snap-fit strap therein; and a rear receptor cavity on the rear edge of the sole-base, the rear receptor cavity operable to hold the rear interlocking snap-fit strap therein.

3. The convertible shoe of claim 2, further comprising:

a plurality of front cavity through holes disposed in the front receptor cavity; and a plurality of rear cavity through holes disposed in the rear receptor cavity.

4. The convertible shoe of claim 3, further comprising a plurality of front sole-base holes on a top front portion of the sole-base and a plurality of rear sole-base holes on a top rear portion of the sole-base, the front sole-base holes communicating with the plurality of front cavity through holes and the rear sole-base holes communicating with the plurality of rear cavity through holes.

5. The convertible shoe of claim 4, further comprising:

a plurality of front interlocking snap-fit strap limbs fitting into the front cavity through holes; and a plurality of rear interlocking snap-fit strap limbs fitting into the rear cavity through holes.

6. The convertible shoe of claim 5, further comprising:

a plurality of front upper limbs fitting into the front sole-base holes; and a plurality of rear upper limbs fitting into the rear sole-base holes.

7. The convertible shoe of claim 6, further comprising:

front upper limb holes formed in the plurality of front upper limbs; and rear upper limb holes formed in the plurality of rear upper limbs, wherein the front upper limb holes receive the plurality of front strap limbs; and the rear upper limb holes receive the plurality of rear strap limbs.

8. The convertible shoe of claim 2, further comprising:

front attachment anchors disposed on ends of the front interlocking snap-fit strap;

rear attachment anchors disposed on ends of the rear interlocking snap-fit strap;

front receptacles, disposed in the front receptor cavity, receiving the front attachment anchors; and rear receptacles, disposed in the rear receptor cavity, receiving the rear attachment anchors.

9. The convertible shoe of claim 1, wherein the front and rear removable shoe uppers are securable to the non-removable sandal-type shoe upper with a hook and loop fastener.

10. The convertible shoe of claim 1, further comprising attachment loops disposed on opposite sides of the non-removable sandal-type shoe upper.

11. The convertible shoe of claim 10, further comprising a detachable adjustable sandal strap operable to connect to the attachment loops and span about a rear of a user's foot when wearing the convertible shoe.

12. A convertible shoe comprising:

a sole-base;

a front interlocking snap-fit strap disposed about a front edge of the sole-base;

a rear interlocking snap-fit strap disposed about a rear edge of the sole-base;

a non-removable sandal-type shoe upper attached to the sole-base;

a front removable shoe upper securable to the non-removable sandal-type shoe upper and to the front interlocking snap-fit strap;

a rear removable shoe upper securable to the non-removable sandal-type shoe upper and to the rear interlocking snap-fit strap;

a front receptor cavity on a front edge of the sole-base, the front receptor cavity operable to hold the front interlocking snap-fit strap therein;

a rear receptor cavity on the rear edge of the sole-base, the rear receptor cavity operable to hold the rear interlocking snap-fit strap therein;

a plurality of front cavity through holes disposed in the front receptor cavity;

a plurality of rear cavity through holes disposed in the rear receptor cavity;

a plurality of front sole-base holes on a top front portion of the sole-base and a plurality of rear sole-base holes on a top rear portion of the sole-base, the front sole-base holes communicating with the plurality of front cavity through holes and the rear sole-base holes communicating with the plurality of rear cavity through holes;

a plurality of front interlocking snap-fit strap limbs fitting into the front cavity through holes;

a plurality of rear interlocking snap-fit strap limbs fitting into the rear cavity through holes;

a plurality of front upper limbs fitting into the front sole-base holes;

a plurality of rear upper limbs fitting into the rear sole-base holes;

front upper limb holes formed in the plurality of front upper limbs;

rear upper limb holes formed in the plurality of rear upper limbs, wherein the front upper limb holes receive the plurality of front interlocking snap-fit strap limbs and the rear upper limb holes receive the plurality of rear interlocking snap-fit strap limbs;

front attachment anchors disposed on ends of the front snap strap;

rear attachment anchors disposed on ends of the rear snap strap;

front receptacles, disposed in the front receptor cavity, receiving the front attachment anchors; and rear receptacles, disposed in the rear receptor cavity, receiving the rear attachment anchors.

* * * * *